US005387891A

United States Patent [19]

Nick

[11] Patent Number: 5,387,891

[45] Date of Patent: Feb. 7, 1995

[54] COIL CONFIGURATION HAVING TWISTED ENDS AND BEING MADE OF A CONDUCTOR WITH SUPERCONDUCTING FILAMENTS

[75] Inventor: Wolfgang Nick, Köln, Germany

[73] Assignee: Siemens Aktiengesellschaft, Munich, Germany

[21] Appl. No.: 217,597

[22] Filed: Mar. 24, 1994

[30] Foreign Application Priority Data

Sep. 25, 1991 [EP] European Pat. Off. ..... 91116350

[51] Int. Cl.[6] ..... H01F 7/22; H01F 5/08

[52] U.S. Cl. ..... 335/216; 336/192; 336/DIG. 1; 505/705; 505/879

[58] Field of Search ..... 335/216, 299; 336/DIG. 1, 192; 174/125.1, 15.4, 15.5; 505/704, 705, 879, 880, 884, 886, 887, 924, 925, 926, 927, 928, 917; 29/599

[56] References Cited

U.S. PATENT DOCUMENTS

| | | | |
|---|---|---|---|
| 3,416,111 | 12/1968 | Bogner . | |
| 3,559,128 | 1/1971 | Kingston et al. | 336/192 |
| 4,038,622 | 7/1977 | Purcell . | |
| 4,270,112 | 5/1981 | Schneider-Muntau et al. | 336/197 |
| 4,277,768 | 7/1981 | Burgeson et al. | 335/216 |
| 4,277,769 | 7/1981 | Hieronymous | 335/216 |
| 4,384,168 | 5/1983 | Kenney . | |
| 4,529,537 | 7/1985 | Borden . | |
| 4,739,200 | 4/1988 | Oberly et al. | 310/10 |
| 4,978,922 | 12/1990 | Mallick, Jr. et al. | 324/652 |
| 5,278,533 | 1/1994 | Kawaguchi | 335/213 |

FOREIGN PATENT DOCUMENTS

| | | |
|---|---|---|
| 0276360 | 8/1988 | European Pat. Off. . |
| 0208163 | 1/1989 | European Pat. Off. . |
| 3724229 | 7/1989 | Germany . |
| WO93/06607 | 4/1993 | WIPO . |

OTHER PUBLICATIONS

Patent Abstract of Japan, vol. 12, No. 69 (E-587)[2916] & JP-A-62-210603 (Mitomo) Sep. 16, 1987.

IEEE Transactions on Nuclear Science, vol. NS-28, No. 3 (Patoux et al.) pp. 3205-3207, Jun. 1981.

Physik in unserer Zeit, (1985) pp. 16-23, (Schmüser) "Supraleitende Magnete für Hera".

Spektrum der Wissenschaft, Oct. 1990, pp. 118-126, (Caya) "Keramische Supraleiter".

Superconducting Magnets (Wilson) Clarendon Press, Oxford, 1989.

*Primary Examiner*—Leo P. Picard

*Assistant Examiner*—Raymond Barrera

*Attorney, Agent, or Firm*—Herbert L. Lerner; Laurence A. Greenberg

[57] ABSTRACT

A coil configuration includes at least one superconducting coil having an associated coil surface and a conductor containing superconducting filaments and being wound substantially on the coil surface. The conductor has a longitudinal axis and has a respective transversal axis oriented approximately perpendicular to the coil surface at each point along the longitudinal axis. The conductor has a cross section being extended along the transversal axis at each of the points along the longitudinal axis. The conductor has two ends protruding from the at least one coil. At least one of the ends has a twist in the vicinity of the at least one coil. The transversal axis is approximately parallel to the coil surface downstream of the twist.

20 Claims, 5 Drawing Sheets

COIL CONFIGURATION HAVING TWISTED ENDS AND BEING MADE OF A CONDUCTOR WITH SUPERCONDUCTING FILAMENTS

CROSS-REFERENCE TO RELATED APPLICATION

This application is a Continuation of International Application Ser. No. PCT/EP92/02106, filed Sep. 14, 1992.

BACKGROUND OF THE INVENTION

Field of the Invention

The invention relates to a coil configuration having at least one superconducting coil with an associated coil surface and a conductor containing superconducting filaments and being wound essentially onto the coil surface, the conductor having a longitudinal axis, the conductor having a cross section at every point of the longitudinal axis being distended or extended along a distension or transversal axis oriented approximately perpendicular to the coil surface, and the conductor having two ends protruding from the coil.

Such coil configurations are used as essential components in many kinds of superconducting magnets, for instance superconducting magnets for particle accelerators, MRI equipment and magnetic separators.

A detailed description of superconducting magnets is found in the book entitled "Superconducting Magnets" by M. N. Wilson, Oxford University Press, Oxford 1989. That book describes possible coil forms in connection with the fields to be generated (Chapter 3) and examples are shown in FIGS. 3.9 and 3.14. In Chapter 12, the book includes detailed information on forming the conductors that contain the superconducting materials. Typically, those conductors include superconducting filaments in matrices of copper, copper alloys or similar metals (see FIG. 12.8), for instance, and are constructed as one-piece strips or as cables, each having a number of preferably round wires being cabled to one another. Practical information on how to construct superconducting coils for various applications is found in Chapter 13 and examples are shown in FIGS. 13.5–13.9.

Other information on magnets with superconducting coil configurations is found in IEEE Transactions on Nuclear Science Vol. NS-28 (1981) page 3205, where various embodiments for dipole magnets with superconducting coil configurations that include coils stacked on one another and fastened in support structures, are described. Other embodiments of magnets with superconducting coil configurations can be found in an article entitled "Supraleitende Magnete für HERA [Superconducting Magnets for HERA]", in Physik in unserer Zeit [Physics in Our Time](1985) 16, and in U.S. Pat. No. 4,038,622 and Published European Application No. 0 276 360 A2. Reference may also be made to European Patent No. 0 208 163 B1 for the use of superconducting coil configurations in particle accelerator systems.

Besides the "classical" superconductors, which are understood to mean certain metals, alloys and intermetallic compounds, having transition temperatures which are quite close to the absolute zero temperature point and which are the only kind discussed in the documents cited above, ceramic superconductors which were discovered a few years ago have transition temperatures that under some circumstances are substantially higher (such superconductors are called "high-temperature superconductors"), and find a use in magnets that has already been considered. A detailed description of the ceramic superconductors known at that time is found in Spektrum der Wissenschaft [Science Spectrum] (1990), page 118. The production of conductors that contain such ceramic superconductors is described in German Published, Non-Prosecuted Application DE 37 24 229 A1.

Flattened conductors, that is conductors which have a longitudinal axis and have a cross section which is extended along a transversal axis at every point of the longitudinal axis, are used particularly for forming heavy-duty coil configurations. Information thereon can be found from the documents cited. Such conductors are wound into coils in such a way that at every point of the longitudinal axis the transversal axis is oriented approximately perpendicular to a coil surface that is defined by the shape and disposition of the coil. In particular, the longitudinal axis in the coil extends essentially parallel to the coil surface. When a flattened conductor is used to produce a coil, it is often difficult to extend the ends of the conductor out of the coil. Since the conductor is always oriented with its transversal axis approximately perpendicular to the coil surface, it was previously bent in a plane that contained the longitudinal axis and the transversal axis, in all of the cases in which one end had to be extended approximately away from the coil surface. However, that presents considerable mechanical strains to the structure of the conductor and under some circumstances can mean that voids are created in the structure and/or that superconducting filaments are damaged, and as a result the load capacity for electric current of the conductor would be restricted. As an alternative to bending the conductor, it is known to solder suitably oriented pieces onto the ends. However, that produces solder points on the coil, which under some circumstances are not superconducting, and have a load capacity which should be understood to mean primarily the maximum value of the electric current that can be conducted through the coil, which can likewise be restricted considerably.

SUMMARY OF THE INVENTION

It is accordingly an object of the invention to provide a coil configuration having twisted ends and being made of a conductor with superconducting filaments, which overcomes the hereinafore-mentioned disadvantages of the heretofore-known devices of this general type.

With the foregoing and other objects in view there is provided, in accordance with the invention, coil configuration comprising at least one superconducting coil having an associated coil surface; and a conductor containing superconducting filaments and being wound substantially on said coil surface, said conductor having a longitudinal axis and having a respective transversal axis oriented approximately perpendicular to said coil surface at each point along said longitudinal axis, said conductor having a cross section being extended along said transversal axis at each of said points along said longitud- inal axis, said conductor having two ends protruding from said at least one coil, at least one of said ends having a twist in the vicinity of said at least one coil, and said transversal axis being approximately parallel to said coil surface downstream of said twist.

The invention utilizes the fact that twisting of a flat conductor tends to cause damage to the internal structure of the conductor substantially less than bending in the plane of the transversal axis. According to the invention, the conductor can easily be bent downstream of a twist without the danger of damage, and can be extended away from the coil by bending it in a plane at right angles to the transversal axis.

In accordance with another feature of the invention, the conductors have an approximately rectangular cross section at every point of their longitudinal axis, and thus make it especially possible to utilize the space available for forming the coil configuration. Conductors having cross sections which are more trapezoidal, rather than rectangular in the strict sense, are especially advantageous for many applications. Such conductors are preferred particularly for producing dipole coils for accelerator systems.

In accordance with a further feature of the invention, the conductor includes at least one matrix into which the superconducting filaments are embedded, being formed of an electrically highly conductive metal, but not one that is superconducting like the filaments. Copper, aluminum and copper alloys are especially suitable for forming the matrix.

In accordance with an added feature of the invention, the materials that are suitable for the filaments are those based on the superconducting intermetallic compounds which are known per se, in particular NbTi or $Nb_3Sn$.

In accordance with an additional feature of the invention, the filaments are formed of a ceramic superconductor, and in particular a ceramic high-temperature superconductor.

In accordance with yet another feature of the invention, the twist has an angle of approximately 90°, so that the transversal axis of the conductor-upstream of the twist intersects the transversal axis downstream of the twist at an angle of approximately 90°.

In accordance with yet a further feature of the invention, the end of the conductor is bent easily and without the danger of material damage downstream of the twist in any coil configuration according to the invention, so as to carry the conductor away from the coil, either to another coil or to a power supply apparatus.

There are many options for constructing the coil surface of the coil configuration according to the invention, and essentially all structures known per se are attainable. In particular, in accordance with yet an added feature of the invention, the coil surface may be approximately flat.

In accordance with still another feature of the invention, the coil surface is approximately cylindrical.

In accordance with still a further feature of the invention, the coil surface has an approximately flat or approximately cylindrical middle segment and two end segments being bent in approximately saddle-like fashion away from the middle segment.

More-complicated constructions of the coil surface are also possible. For instance, the coil surface may be constructed with an approximately flat or approximately cylindrical middle segment and two end segments being bent away from the middle segment in approximately saddle-like fashion. Coils with coil surfaces of this kind are known as "saddle coils", "bed frame coils" and "banana coils".

In accordance with yet an additional feature of the invention, a first coil and a second coil are in line with one another, with the same coil surface being associated with both coils and the first coil resting on the second coil at the coil surface.

In accordance with again another feature of the invention, a connection between the first coil and the second coil is achieved by joining an end protruding from the first coil and having a twist, to an end protruding from the second coil and likewise having a twist. This kind of connection of two coils can be achieved as needed in such a way that the first coil is wound first, and the second coil is wound immediately on top of it, with one and the same conductor.

In accordance with again a further feature of the invention, the coil has at least one middle region and at least one end region, the conductor in the end region is bent substantially more markedly than in the middle region, and an end of the coil having the twist according to the invention is disposed in the middle region, or directly at the middle region. In this way fastening the coil configuration according to the invention within a support structure, in particular a collar, becomes especially simple. Coils with a middle region and an end region are found in the form of dipole coils in accelerator systems, for instance, where "racetrack" or "banana" forms of coils are used. In coils of the first of these forms, two straight middle regions that are parallel to and next to one another are present and are joined to one another through two relatively tightly bent end regions. The second of these forms differs from the first in that the middle regions are in turn bent, although with markedly larger radii of curvature than the end regions.

In accordance with again an added feature of the invention, each end protruding from the coil has the twist according to the invention.

In many cases, in a conductor for use in a coil configuration, the superconducting filaments are twisted together, often in such a way that this defines a certain helical direction. In accordance with again an additional feature of the invention, in any embodiment in which such a conductor is used, the twist of the overall conductor according to the invention is counter to the helical direction that is defined by the twist of the superconducting filaments. This provision gives mechanical relief to the superconducting filaments inside the conductor. The danger of damage to the filaments from the process of making the twist can be counteracted in this way.

Often conductors in the form of cables are used to form coil configurations, where one cable includes a number of cabled-together elements, such as wires. The cabling of the elements in the cable usually defines a certain helical direction. In accordance with a concomitant feature of the invention, within the scope of any version of the invention, the twist of the cable representing the conductor is counter to the helical direction defined by the cabling of the elements, so that the cabling of the elements of the cable is reinforced by the making of the twist according to the invention. This provision prevents individual elements of the cable in the twist from becoming movable, which could impair the load capacity of the coil configuration. Since the cohesion of the elements of the cable is not loosened but rather strengthened, such a danger is reliably prevented. It should be noted that this last advantageous provision is not in contradiction with the provision described before. It is highly conceivable to form a conductor as a cable from elements each of which includes twisted superconducting filaments in a matrix. In such a case, however, a helical direction defined by a twist of the superconducting filaments is then typically counter to a helical direction that is defined by a twisting of the elements. In such a conductor, both of these last two advantageous provisions described above are in fact achievable in combination, to further advantage, within the scope of the invention.

Finally, it should be noted that the invention also makes it possible to use cables of complex construction, in which the elements being cabled to one another are in turn cables.

Other features which are considered as characteristic for the invention are set forth in the appended claims.

Although the invention is illustrated and described herein as embodied in a coil configuration having twisted ends and being made of a conductor with superconducting filaments, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
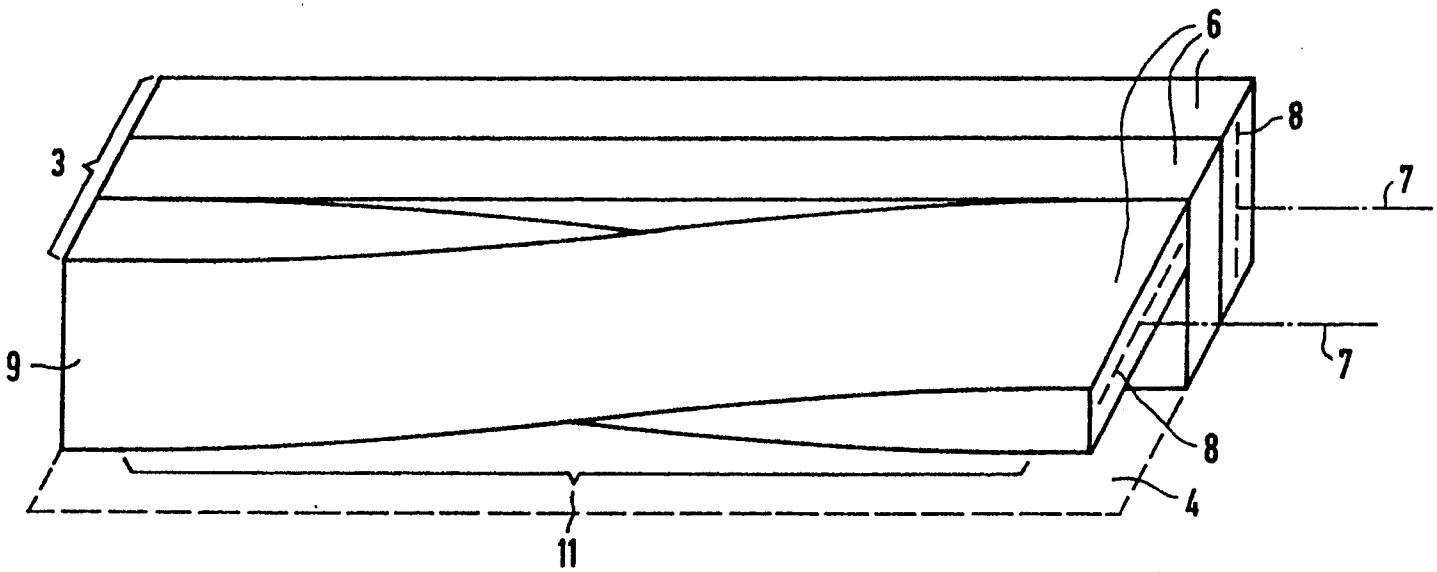
FIG. 1 is a diagrammatic, perspective view of portion of a coil in a coil configuration according to the invention with twisting.

Referring now in detail to the figures of the drawing, which are not to scale and are slightly extended where useful in order to emphasize the specific characteristics of the invention, and first, particularly, to FIG. 1 thereof, there is seen a portion of a coil 3 within the scope of a coil configuration according to the invention, having a coil surface 4 that is represented by a portion which is illustrated as a segment of a plane. The coil 3 includes a wound-up conductor 6, which contains superconducting material that is not shown in FIG. 1. The conductor 6 has a longitudinal axis 7 and at each point along the longitudinal axis 7 it has a cross section that is distended or extended along a distension or transversal axis 8, so that in the present example it is rectangular. In the actual coil 3 itself, the transversal axis 8 is always oriented at an obtuse angle, and is preferably approximately perpendicular to the coil surface 4. This proves to be advantageous because of factors that affect the penetration of the conductor 6 by a magnetic field to be generated by the coil 3. The conductor 6 is extended out of the coil 3 at one end 9. According to the invention, this end 9 has a twist 11, downstream of which the transversal axis 8 is no longer oriented perpendicular to the coil surface 4, but rather parallel to it. This twist 11 is especially advantageous because downstream of it, the conductor 6 can easily be bent and carried away from the coil surface 4 at an obtuse angle, in particular at approximately a right angle. Downstream of the twist 11, the conductor 6 again conforms to the coil 3. This is especially advantageous whenever the coil 3 is to be fastened inside a support structure. Such support structures are described, for instance, in the aforementioned article from "Physik in unserer Zeit" [Physics in our Time] and therefore require no further discussion at this point.

Figure 2:
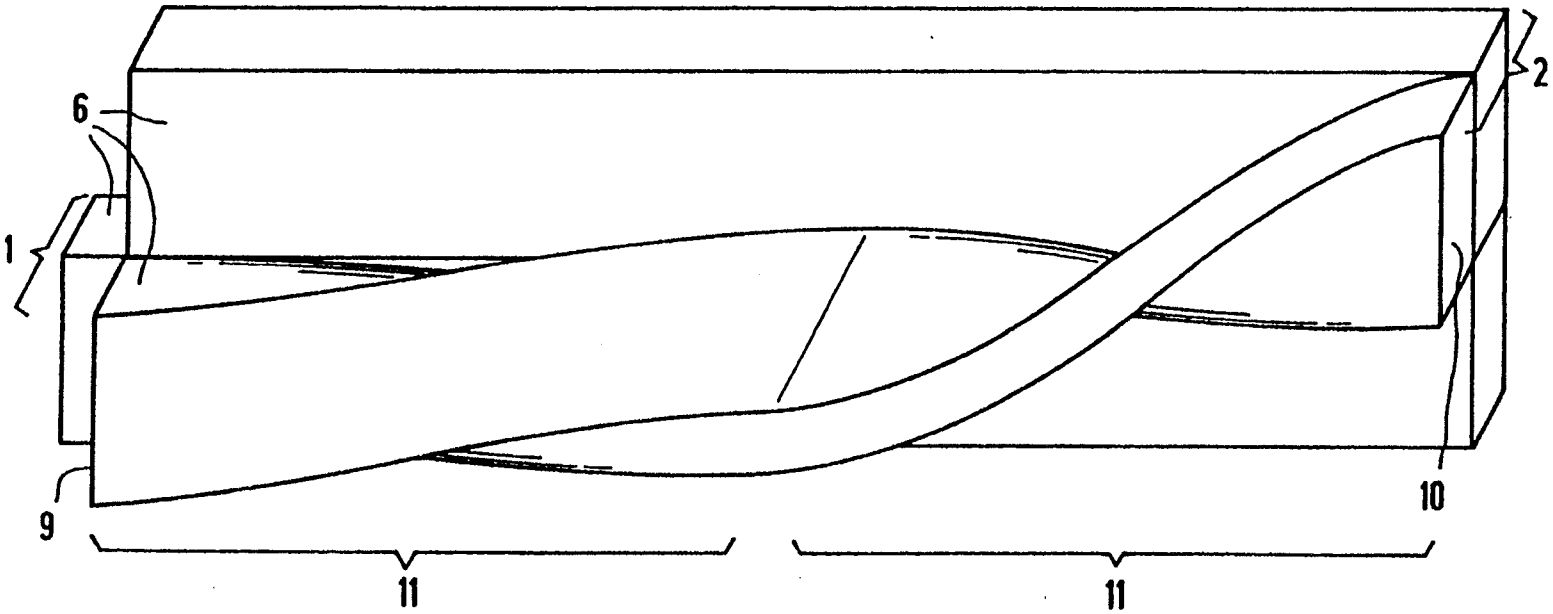
FIG. 2 is a view similar to FIG. 1 of a portion of a coil configuration according to the invention with twisting, wherein the configuration has two coils resting on one another.

FIG. 2 shows a portion of a coil configuration having a first coil 1 and a second coil 2, with the second coil 2 resting on the first coil 1. A coil surface which is not shown in FIG. 2 can be imagined as being located between the first coil 1 and the second coil 2, for instance. The first coil 1 and the second coil 2 are wound from a single conductor 6, which is extended at one end 9 out of the first coil 1 and at another end 10 into the second coil 2. The conductor 6 has two twists 11 according to the invention between the ends 9 and 10. The inclusion of these twists 11 makes it possible to extend the conductor 6 between the first coil 1 and the second coil 2 with minimum deformation. Both twists 11 have the same helical direction. This is advantageous because it avoids an otherwise possible danger of collapse of the twists 11. In many cases, in the conductors 6 being used, there are also inherent helical directions, which favor one of the two helical directions that is possible when a twist 11 is made.

Figure 3:
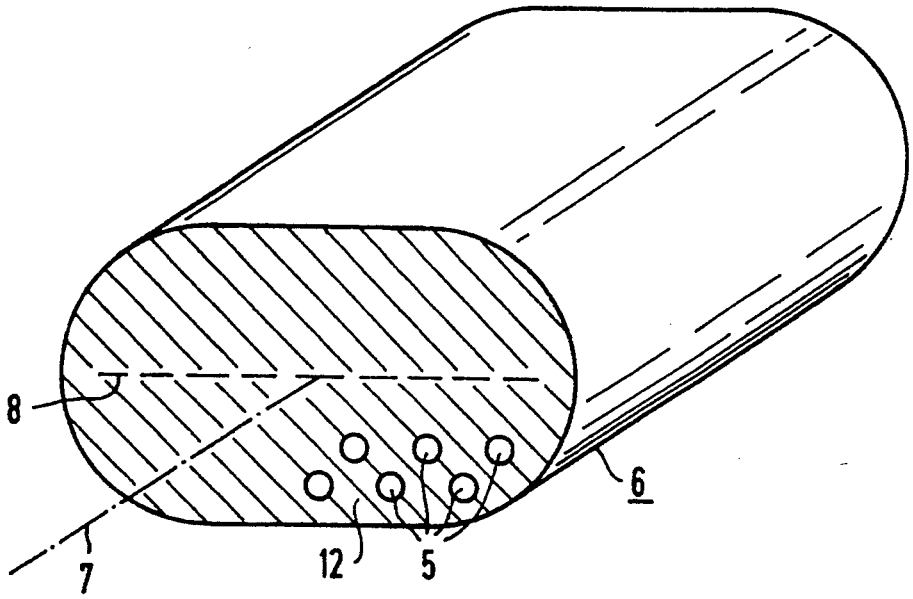
FIG. 3 is a perspective view of a strip with superconducting filaments for use within the scope of the invention.

FIG. 3 shows a diagrammatic example of a strip that is usable as a conductor 6 within the scope of the invention. The conductor 6 has a longitudinal axis 7 and, as already noted, it has a cross section at each point along the longitudinal axis 7 that is extended along a transversal axis 8. The conductor 6 includes a matrix 12 of a metal such as copper. Superconducting filaments 5 are embedded in the matrix 12. As a rule, the superconducting filaments 5 are distributed largely regularly over the matrix 12. For the sake of simplicity, only a few filaments 5 are shown.

Figure 4:
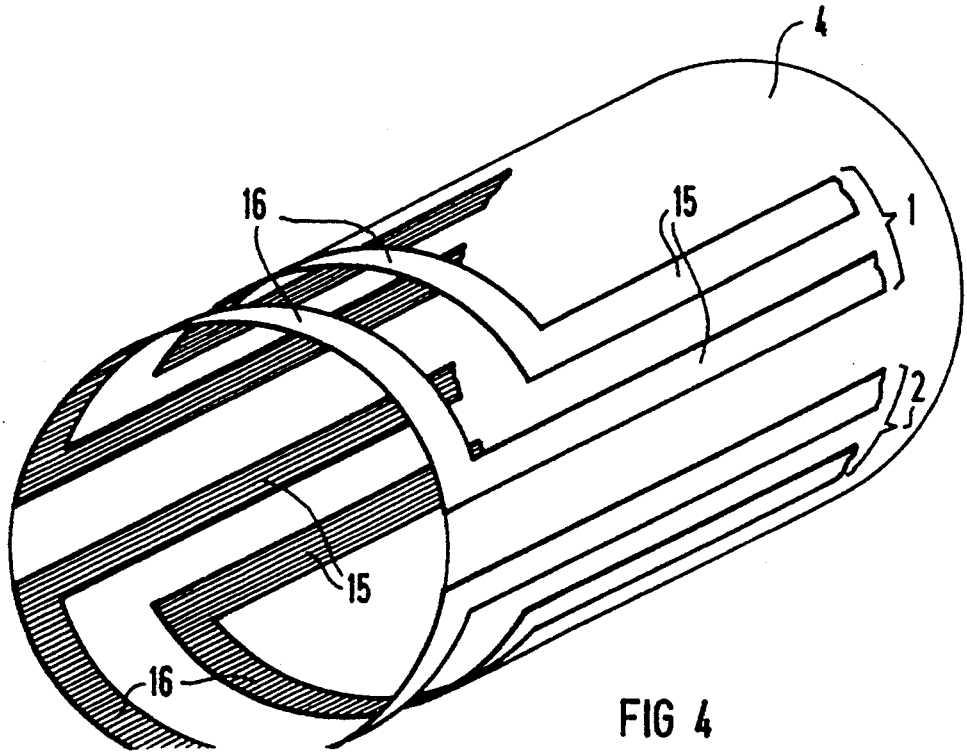
FIG. 4 is a perspective view of an example of a coil configuration with a cylindrical coil surface.

FIG. 4 shows an exemplary embodiment of a coil configuration in which the invention can be used. The coil configuration includes a first coil 1 and a second coil 2. Both of the coils 1, 2 are in multiple parts and face one another on a cylindrical coil surface 4. Each of the coils 1, 2 has middle regions 15 that are straight and that communicate with one another through bent end regions 16. According to the invention, connections of the parts of the coils 1, 2 with one another and connections between the first coil 1 and the second coil 2 can both be provided. Power leads which are necessary for operation of the coil configuration can also be connected to the coils 1, 2 through twists according to the invention.

Figure 5:
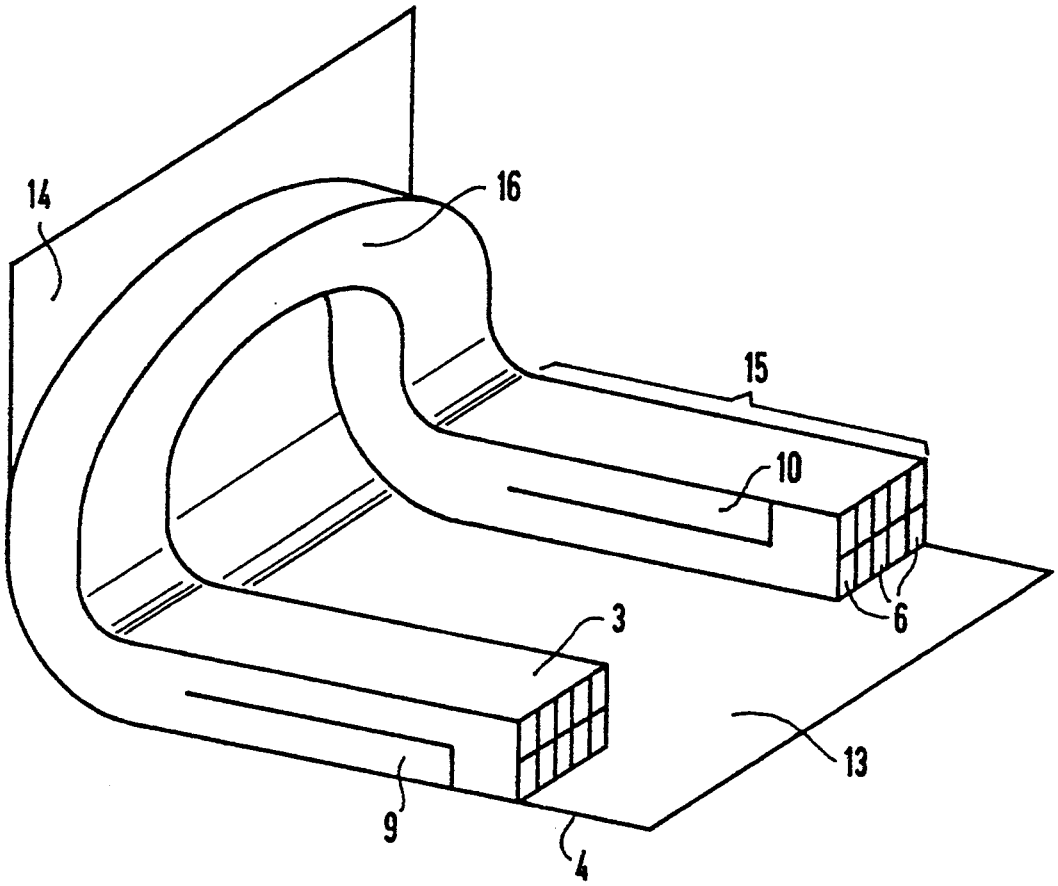
FIG. 5 is a perspective view of an example of a coil configuration with a coil surface having a complex structure.

FIG. 5 shows a portion of a further example of a coil 3 made from a superconducting conductor 6. The coil 3 again has approximately straight middle regions 15, which are joined together by a curved end region 16. The conductor 6 begins at one outer end 9 and ends at one inner end 10. For the sake of simplicity, both ends 9, 10 are shown as being oriented parallel to a middle region 15. In the example shown, the coil surface 4 of the coil 3 has a flat middle segment 13 and an end segment 14 that is approximately at a right angle to the middle segment 13. This makes the illustrated coil 3 a so-called "bed frame coil" or "saddle coil". In order to form a "banana coil" the middle region 15 may also be given a slight curvature extending within the flat middle segment 13.

Figure 6:
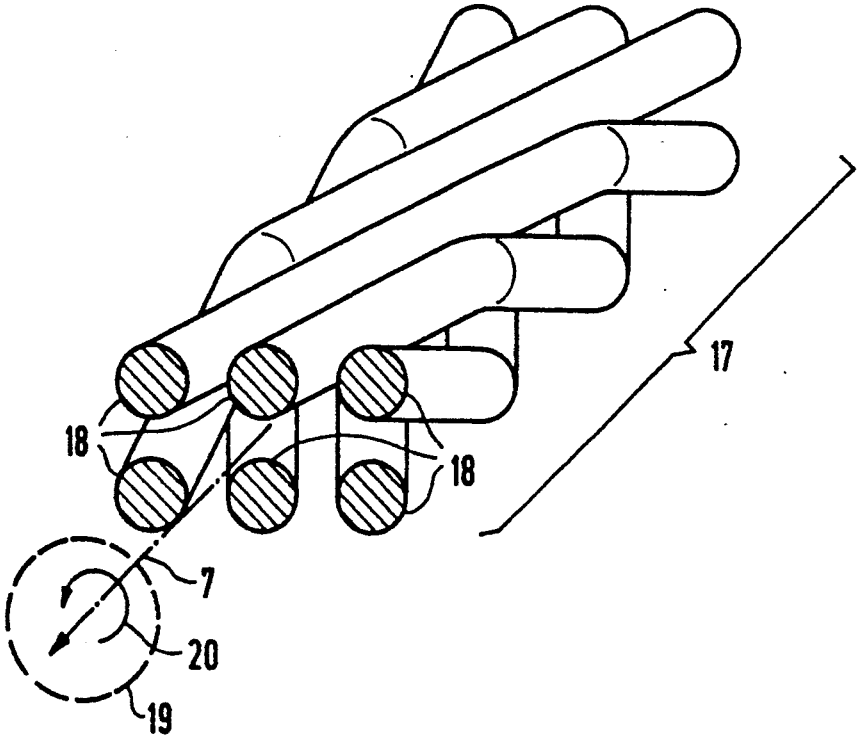
FIG. 6 is a perspective view of a cable for use within the scope of the invention.

FIG. 6 shows a way in which a cable 17 can be formed by cabling together a number of elements 18. The cable 17 has a longitudinal axis 7, which is provided with a directional arrow in order to explain a helical direction 19 defined by the cabling of the elements 18. The elements 18 are extended around the longitudinal axis 7 in a direction of rotation 20 relative to this oriented longitudinal axis 7. The helical direction 19 is unequivocally defined from the combination of the oriented longitudinal axis 7 and the direction of rotation 20. On one hand the cable 17 may represent a conductor that is intended to make up a coil configuration according to the invention. In that case, the elements 18 could include superconducting filaments embedded in a matrix as seen in FIG. 3. The cable 17 may also represent a twisting of superconducting filaments in a strip intended to make a coil configuration according to the invention. In that case, the elements 18 are the superconducting filaments themselves.

The invention makes it possible to form coil configurations from superconducting conductors, in which a major deformation of the conductor is maximally avoided, thus preventing impairments to operating safety.

I claim:

1. A coil configuration comprising:

at least one superconducting coil having an associated coil surface; and a conductor containing superconducting filaments and being wound substantially on said coil surface, said conductor having a longitudinal axis and having a respective transversal axis oriented approximately perpendicular to said coil surface at each point along said longitudinal axis, said conductor having a cross section being extended along said transversal axis at each of said points along said longitudinal axis, said conductor having two ends protruding from said at least one coil, at least one of said ends having a twist in the vicinity of said at least one coil, and said transversal axis being approximately parallel to said coil surface downstream of said twist.

2. The coil configuration according to claim 1, wherein said cross section of said conductor is approximately rectangular at every point along said longitudinal axis.

3. The coil configuration according to claim 1, wherein said conductor has at least one matrix of highly electrically conductive metal, in particular copper or aluminum, in which said filaments are embedded.

4. The coil configuration according to claim 3, wherein said highly electrically conductive metal is selected from the group consisting of copper and aluminum.

5. The coil configuration according to claim 1, wherein said filaments are substantially formed of a superconducting intermetallic compound.

6. The coil configuration according to claim 5, wherein said superconducting intermetallic compound is selected from the group consisting of NbTi and $Nb_3Sn$.

7. The coil configuration according to claim 1, wherein said filaments are substantially formed of a ceramic superconductor.

8. The coil configuration according to claim 7, wherein said ceramic superconductor is a ceramic high-temperature superconductor.

9. The coil configuration according to claim 1, wherein said twist corresponds to an angle of approximately 90°.

10. The coil configuration according to claim 1, wherein said at least one end is bent downstream of said twist.

11. The coil configuration according to claim 1, wherein said coil surface is approximately flat.

12. The coil configuration according to claim 1, wherein said coil surface is approximately cylindrical.

13. The coil configuration according to claim 1, wherein said coil surface has an approximately flat middle segment and two end segments being bent in approximately saddle-like fashion away from said middle segment.

14. The coil configuration according to claim 1, wherein said coil surface has an approximately cylindrical middle segment and two end segments being bent in approximately saddle-like fashion away from said middle segment.

15. The coil configuration according to claim 1, wherein said at least one coil includes a first coil and a second coil, said coil surface is associated with both of said coils, and said first coil rests on said second coil at said coil surface.

16. The coil configuration according to claim 15, wherein said at least one end includes an end protruding from said first coil and having a twist and an end protruding from said second coil and having a twist, said ends being joined together.

17. The coil configuration according to claim 1, wherein said at least one coil has at least one middle region and at least one end region, said conductor is bent substantially more in said end region than in said middle region, and said end having said twist is located in said middle region.

18. The coil configuration according to claim 1, wherein each of said ends protruding from said at least one coil has a twist.

19. The coil configuration according to claim 1, wherein:

a) said superconducting filaments in said conductor are twisted in one helical direction; and b) said twist of said conductor is counter to said one helical direction.

20. The coil configuration according to claim 1, wherein:

a) said conductor is a cable including a number of elements being cabled in one helical direction; and b) said twist of said conductor is counter to said one helical direction.

* * * * *